US005791394A

United States Patent [19]

Huang

[11] Patent Number: 5,791,394

[45] Date of Patent: Aug. 11, 1998

[54] ADJUSTABLE BLIND RAIL

[76] Inventor: Fang-Mei Huang, No. 20, Min Chih Street, Taichung, Taiwan

[21] Appl. No.: 823,687

[22] Filed: Mar. 25, 1997

[51] Int. Cl.[6] ..... A47H 15/00

[52] U.S. Cl. ..... 160/345; 16/95 D; 16/96 D

[58] Field of Search ..... 160/345, 346, 160/347, 344, 341, 342, 330, 126; 16/94 D, 95 D, 96 D

[56] References Cited

U.S. PATENT DOCUMENTS

| | | | |
|---|---|---|---|
| 1,904,588 | 4/1933 | Weinberg | 160/345 |
| 3,155,149 | 11/1964 | Ford | 160/346 |
| 3,234,997 | 2/1966 | Ford | 160/345 |
| 3,337,903 | 8/1967 | Kenney | 160/345 X |
| 3,345,678 | 10/1967 | Graber et al. | 160/345 X |
| 3,736,620 | 6/1973 | Williamson | 16/96 D X |
| 3,946,791 | 3/1976 | Brown | 160/345 |
| 3,978,904 | 9/1976 | Riebock et al. | 160/345 |
| 4,733,435 | 3/1988 | Darner | 160/345 |

*Primary Examiner*—David M. Purol
*Attorney, Agent, or Firm*—Browdy and Neimark

[57] ABSTRACT

An improved adjustable window blind rail having a rail, two end fitting members, two guide members, a plurality of slide members, a pull cord, and two adjusting members. The guide members and the slide members are received in the rail such that they can slide in the direction of the longitudinal axis of the rail. The pull cord is wound on the two end fitting members engaged to the outer ends of the two adjusting members and is received in the rail such that the pull cord is connected with the two guide members. The two adjusting members are mounted at both ends of the rail such that they are capable of moving in the direction of the longitudinal axis of the rail for adjusting the length formed by the rail.

5 Claims, 5 Drawing Sheets

ADJUSTABLE BLIND RAIL

FIELD OF THE INVENTION

The present invention relates generally to a window blind, and more particularly to an adjustable window blind rail.

BACKGROUND OF THE INVENTION

As shown in FIG. 1, a prior art window blind rail has a large tube body 10, a small tube body 12 which is similar in cross sectional profile to the large tube body 10 and is received in the large tube body 10, a left guide member 13, a right guide member 14, a plurality of sliding members 16, a left cover 17, a right cover 18, and a pull cord 19 wound on the guide wheel of the two covers 17 and 18 such that the pull cord 19 is received in the large tube body 10 and the small tube body 12 and that the pull cord 19 is connected with two guide members 13 and 14 to form a loop. The top edge of the blind body is engaged with the guide members 13 and 14, the sliding member 16, and the bottom edges of the two covers 17 and 18. As the pull cord 19 is pulled, the guide members 13 and 14 are actuated to move closer to each other or to move away from each other, thereby causing the blind body to open or close.

The prior art blind rail is characterized in that the rail has the smallest length X, such as 3 feet, when the small tube body 12 is completely received in the large tube body 10. When the small tube body 12 is extended out of the large tube body 10 to a fullest extent, the length of the entire rail is approximately twice its smallest length such as 6 feet. In view of the adjustable rail, the window blind can be installed in an adjustable manner without cutting the rail to fit the specific situation.

However, the prior art blind rail is defective in design in that its size does not always meet the requirements of consumers, and that it often results in a waste of material. Further, the guide member 14, must be cut or readjusted so as to facilitate the installing of the pull cord 19 at such time when the blind rail has a maximum length of 6 feet. Still further, it is inconvenient for the consumer to readjust the overall length of the entire window blind.

SUMMARY OF THE INVENTION

It is therefore the primary objective of the present invention to provide an adjustable blind rail, which can be adjusted with ease and speed.

It is another objective of the present invention to provide an improved adjustable blind rail which can be made economically.

It is still another objective of the present invention to provide an improved adjustable blind rail which is made in such a manner that the consumers are asked to pay for what they get and not for extra material they don't need.

The objectives, features and the functions of the present invention will be more readily understood upon review the following detailed description of the present invention in conjunction with the accompanying drawings.

DETAILED DESCRIPTION OF THE INVENTION

Figure 1:
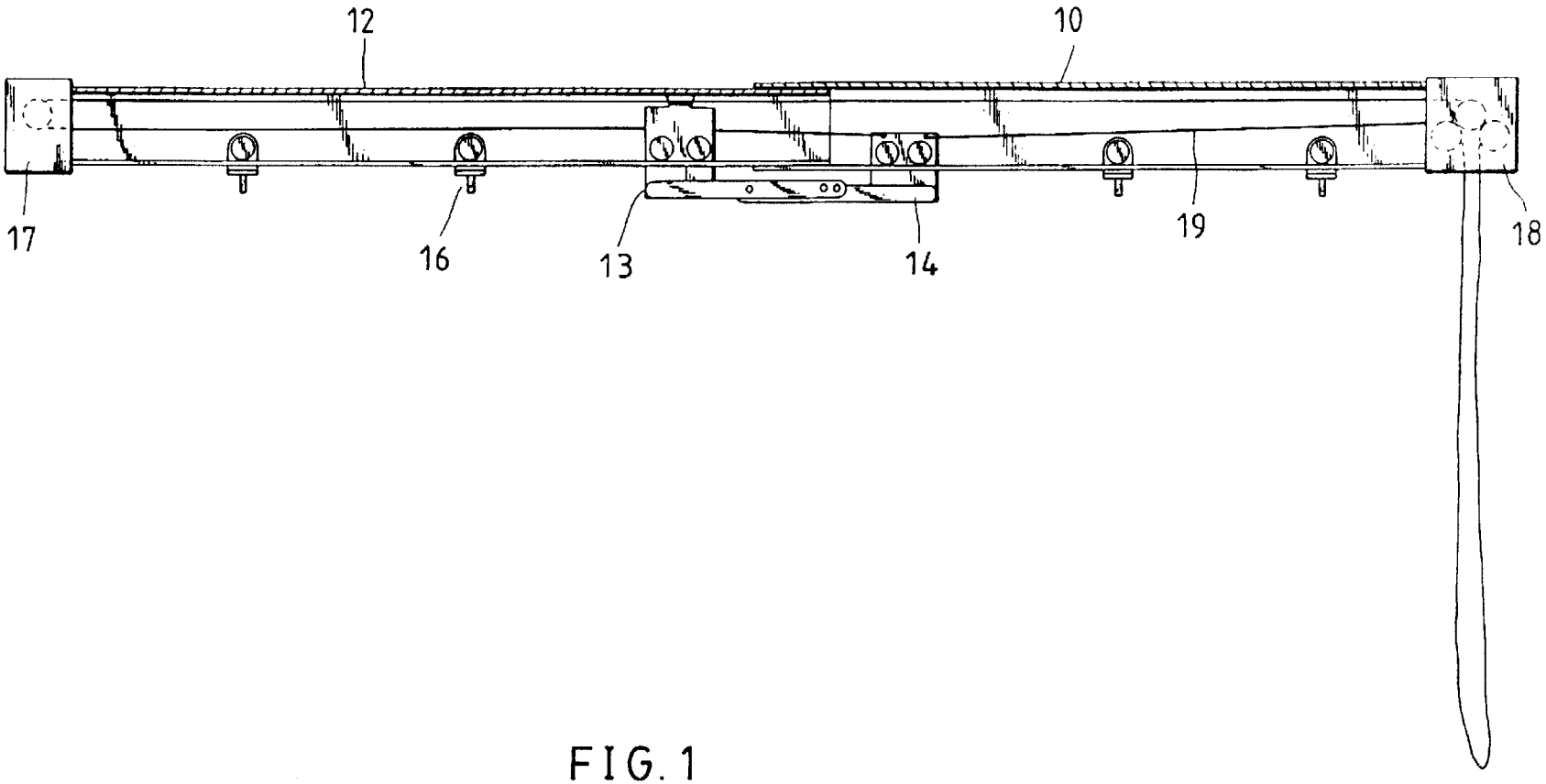
FIG. 1 PRIOR ART
FIG. 1 shows a schematic view of an adjustable blind rail of the prior art.
Figure 2:
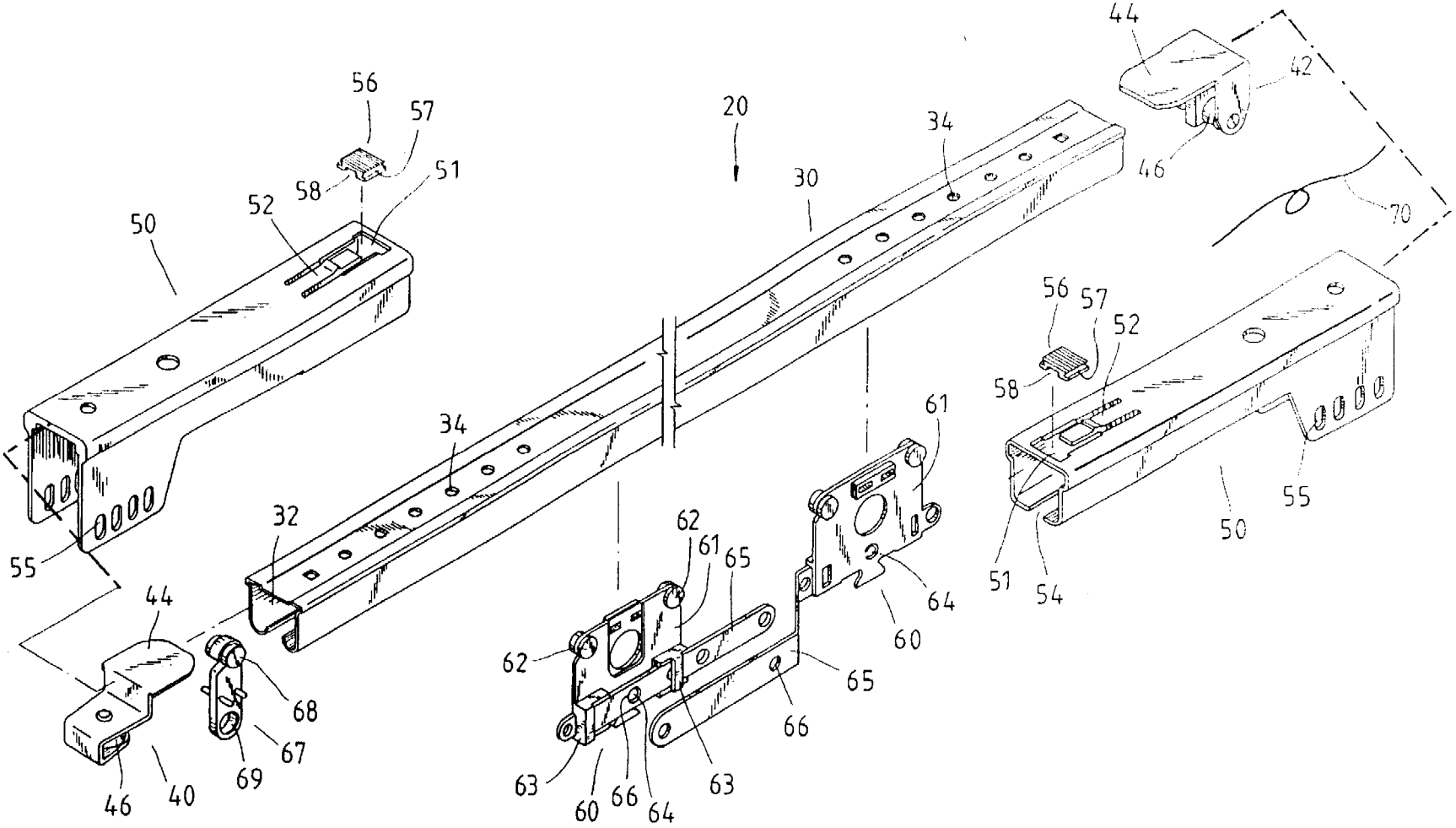
FIG. 2 shows an exploded view of an embodiment of the present invention.
Figure 3:
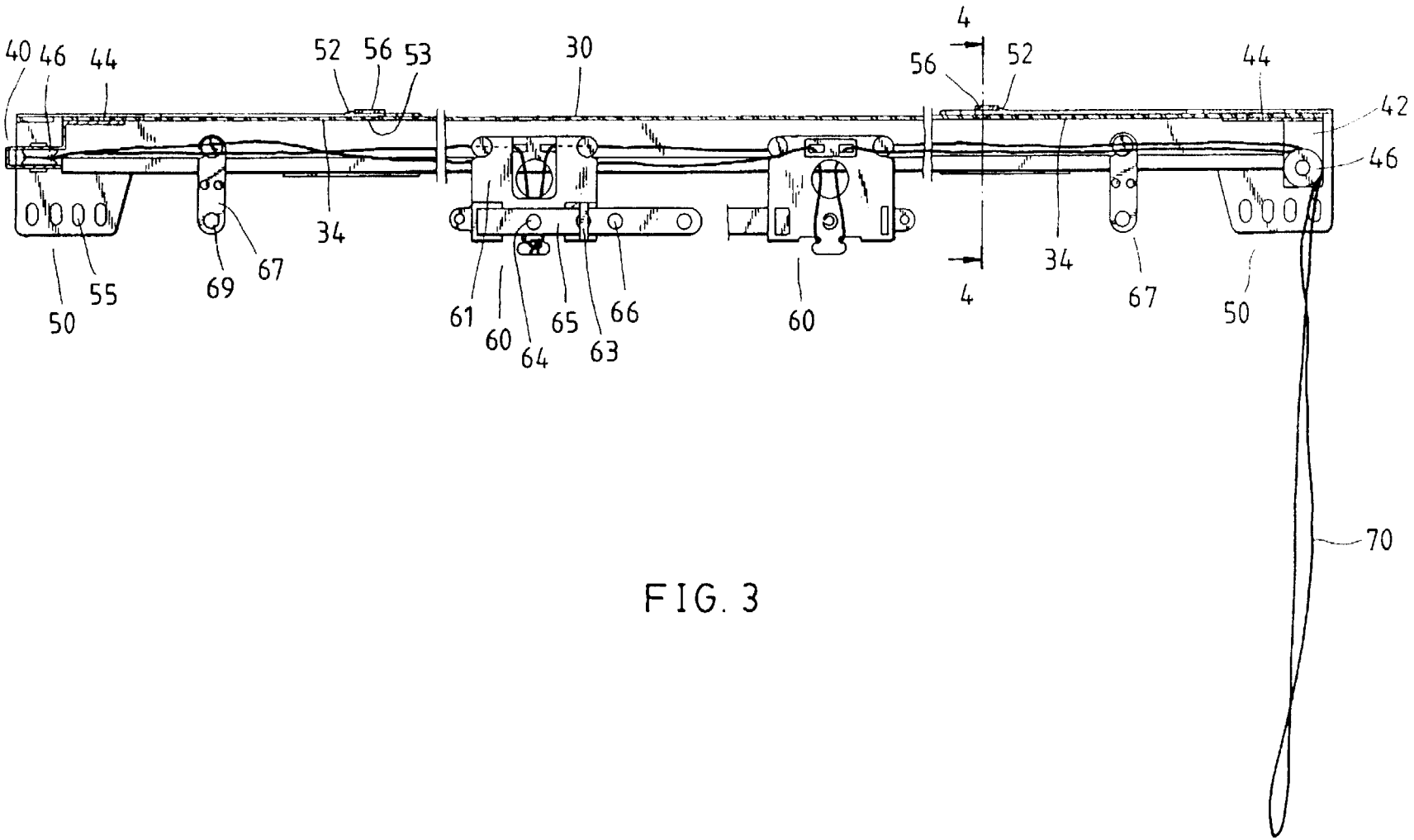
FIG. 3 shows a sectional elevation view of the present invention in combination.
Figure 4:
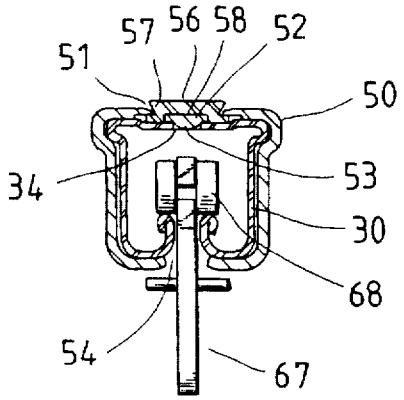
FIG. 4 shows a sectional view taken along the direction indicated by a line 4—4 shown in FIG. 3.
Figure 5:
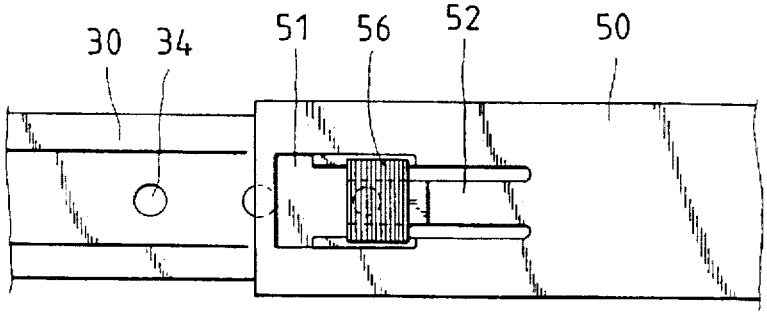
FIG. 5 shows a partial top view of the section as shown in FIG. 3.

As shown in FIGS. 2 and 3, the window blind member 20 of the present invention comprises a number of component parts, which are described hereinafter.

A rail 30 of an M-shaped construction is provided therein with a slide channel 32 and is further provided respectively on both sides of the top thereof with a predetermined number of insertion holes 34 which extend axially and are arranged equidistantly. The rail 30 is fastened with a window sill, wall surface or ceiling by means of a window blind frame (not shown in the drawings).

Two end fitting members 40 and 42 are provided respectively at the top wall of main body thereof with a flat connecting portion 44 extending toward the mid-point of rail 30 when engaged. Each fitting member is provided in the main body thereof with one or two guide wheels 46. The two end fitting members 40 and 42 are fastened respectively with two ends of the rail 30 such that the connecting portion 44 is connected with the inner top wall of the rail 30.

Two adjusting members 50 of a hollow rectangular construction are similar in cross-sectional profile to the rail 30. Each adjusting member 50 is provided at the front end of the top wall thereof with an open space 51 having at the rear end thereof an elastic connection member 52 extending forward and horizontally into space 51. Connection member 52 has a free end which is provided at the bottom thereof with a protruded portion 53. The adjusting member 50 has an a slot 54 which opens to the bottom axially along member 50. The adjusting member 50 has a rear upright wall 50, provided with a plurality of hook holes 55. The adjusting member 50 comprises a press member 56 of a rectangular construction and provided respectively on both sides thereof with an insertion slot 57 and in the underside thereof with a recess 58 extending axially. The two slots 57, are engaged with two side edges of open space 51 such that the press member 56 is movable in space 51. When the press member 56 has been pushed to the front end of the open space 51, the press member 56 is completely disengaged from the connection member 52. When the press member 56 is engaged with the connection member 52, the connection member 52 is inserted into the recess 58 of the press member 56 such that the connection member 52 is covered by the press member 56. Each adjusting member 50 is secured to the outer circumferential edge of the rail 30 such that the connection member 52 is retained in one of the insertion holes 34 of the rail 30. The two end fitting members 40 and 42 are enclosed in the two adjusting members 50.

Each of two guide members 60 have a main body 61 which is provided at the top end thereof with rollers 62 and at the bottom edge of one side thereof with two insertion portions 63 and an elastic protruded portion 64 located between the two insertion portions 63. Each guide piece 65 engaged to guide member 60 has a plurality of hook holes 66 and is engaged with the two insertion portions 63 of the main body 61 such that the guide piece 65 remains partially outside the main body 61. A hook hole 66 of the guide piece 65 is engaged with the protruded portion 64. Each of two slide members 67 is provided at the top thereof with a roller 68. The guide members 60 and the slide members 67 are received in the slide channel 32 of the rail 30 such that they are capable of sliding along the direction of the longitudinal axis of the rail.

A pull cord 70 is wound on the guide wheel 46 of the end fitting members 40 and 42 and is received in the rail 30 so as to form a loop. The pull cord 70 is fastened to each guide member 60 for actuating the guide members 60 to slide. The pull cord 70 extends through the adjusting member 50 to facilitate the pulling of the pull cord 70.

The operation of the present invention is illustrated in FIG. 3. The window blind body has respectively top edge hooks, which are engaged with the hook holes 55, 66 and 69 of the guide members 60, the slide members 67 and the adjusting members 50. When the pull cord 70 is pulled, the guide members 60 are moved toward or away from each other, and with the slide members 67 actuate opening and closing of the blind body.

Each adjusting member 50 is mounted on the rail 30 such that the connecting member 52 of the adjusting member 50 is engaged with one of the insertion holes 34, thereby resulting in causing each press member 56 to slide toward the rear end of open spaces 51. As a result, the connecting member 52 is inserted into the recess 58 such that the connecting member 52 is confined by the press member 56, and that the protruded portion 53 of the connecting member 52 is secured in an insertion hole 34.

Figure 6:
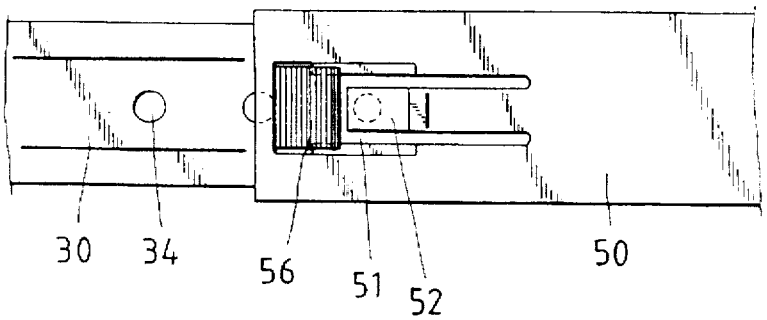
FIG. 6 is a partial top view showing that the press member of the adjusting member of the present invention is being relieved of the braking action.

The disengagement of the connecting member 52 with the rail 30 can be brought about by a reverse action in which the press member 56 is caused to move toward the front end of open space 51 so as to move away from the connecting member 52, as shown in FIG. 6. As a result, the connecting member 52 is no longer confined by the press member 56 and is able to engage another insertion portion 34.

Figure 7:
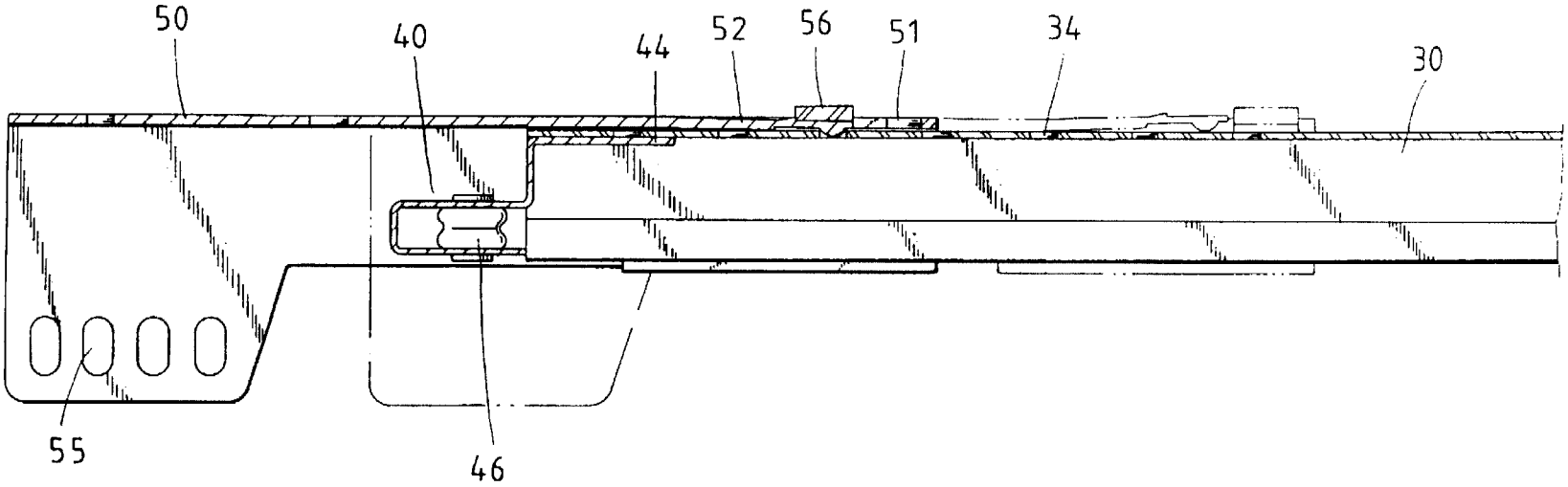
FIG. 7 is a sectional view similar to FIG. 3 for showing the adjustment of the present invention.

In the adjusting of the length of the blind member 20, the two adjusting members 50 are caused to slide along the direction of the longitudinal axis of the rail 30 such that the connecting portion 52 is engaged with an insertion hole 34 for adjusting the length of the rail 30 and the adjusting member 50, as shown in FIG. 7. For example, the distance between two adjoining insertion holes 34 is 0.05 feet. Assuming first that the adjusting members 50 are engaged with the rail 30 such that the length formed by the rail 30 and the adjusting member 50 is 4 feet. Thereafter each adjusting member 50 is moved inwards to engage another insertion hole 34, the length formed by the rail 30 (including the adjusting member 50) is 3.9 feet. When the adjusting members 50 are further moved outward to engage other insertion holes 34, the length is 4.1 feet and so forth. The blind member 20 is therefore adapted to any desired position.

The length of the rail 30 can be specified in a mass production in conjunction with the adjusting member 50, so as to have various specifications of 3, 4, 5 and 6 feet. Each specification can be adjusted by the adjusting member in an adjusting range. For example, for the length of 4 feet the adjusting range is 3.5 feet to 4.5 feet.

On the basis of the description of the embodiment of the present invention, it is therefore readily apparent that the present invention has several inherent advantages, which are described hereinafter.

The present invention can be produced in a large scale to provide the consumers with the blind members of various length specifications, which can be installed adjustably. For example, the present invention with the rail having the length of 6 feet can be adjustably installed in a 3-foot position.

The slide members 65 of the present invention can be adjusted according to the length of the rail. As a result, the present invention can be produced in a cost-effective way.

In the process of installing the present invention, it is not necessary to adjust the pull cord. The only thing that has to be adjusted is the adjusting member with regard to the length of the rail. As a result, the adjusting of the present invention can be done with ease and speed.

The embodiment of the present invention described above is to be regarded in all respects as being merely illustrative and not restrictive. Accordingly, the present invention may be embodied in other specific forms without deviating from the spirit thereof. For example, the rail of the present invention may have an M-shaped or J-shaped cross section. In addition, the sliding and locating structures of the adjusting members and the rail of the present invention may take various forms. The present invention is therefore to be limited only by the scopes of the following claims.

What is claimed is:

1. An adjustable window blind rail comprising:

a rail;

two end fitting members provided respectively therein with a guide wheel mounted on both ends of said rail;

two guide members and a predetermined number of slide members received in said rail such that said slide members are capable of sliding in the direction of a longitudinal axis of said rail; and a pull cord wound on said guide wheels of said two end fitting members such that said pull cord is received in said rail, and that said pull cord is connected with said two guide members to emerge from one of said two end fitting members; and wherein said rail is provided in a periphery of each of two ends therewith with a predetermined number of insertion holes;

wherein said rail is provided of two adjusting members of a hollow construction, and two connecting members connected respectively with said two adjusting members, said two adjusting members being fitted respectively over two ends of said rail such that said two end fitting members are enclosed in said adjusting members and that said adjusting members are capable of sliding along the direction of a longitudinal axis of said rail, said connecting members being engaged with said insertion holes of said rail such that said adjusting members can be located on said said rail for adjusting the length of rail.

2. The adjustable window blind rail as defined in claim 1, wherein said guide members have a main body and a guide piece, said main body provided at one edge thereof with a roller and at a bottom edge on one side thereof with two connection portions and an elastic protruded portion, said guide piece provided with a plurality of hook holes and engaged with said connection portions of said main body such that one of said hook holes is engaged with said protruded portion.

3. The adjustable window blind rail as define in claim 1, wherein said two end fitting members are connected with an inner wall of said rail.

4. The adjustable window blind rail as defined in claim 1, wherein each of said adjusting members is provided at one end thereof with an open space, said connecting member having a free end extending toward one end of said open space, said connecting member being provided on an underside of said free end with a protruded portion engageable with an insertion hole of said insertion holes; and wherein each of said adjusting members further comprises a press member, said press member having insertion slots respectively engageable with two opposite side edges of said open space such that said press member is capable of sliding in said open space to engage said connecting member so as to engage said protruded portion in said insertion hole.

5. The adjustable window blind rail as defined in claim 4, wherein said press member is provided in an underside thereof with a recess extending aling a longitudinal axis thereof; and wherein said connecting member is inserted into said recess when said connecting member is engaged by said press member.

* * * * *